US006706319B2

(12) United States Patent
Seth et al.

(10) Patent No.: US 6,706,319 B2
(45) Date of Patent: Mar. 16, 2004

(54) MIXED POWDER DEPOSITION OF COMPONENTS FOR WEAR, EROSION AND ABRASION RESISTANT APPLICATIONS

(75) Inventors: Brij B. Seth, Maitland, FL (US); Gregg P. Wagner, Apopka, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 28 days.

(21) Appl. No.: 10/206,416

(22) Filed: Jul. 26, 2002

(65) Prior Publication Data

US 2003/0126800 A1 Jul. 10, 2003

Related U.S. Application Data

(60) Provisional application No. 60/336,825, filed on Dec. 5, 2001.

(51) Int. Cl.[7] ..... B05D 1/12; B05D 5/02

(52) U.S. Cl. ..... 427/190; 427/191; 427/201

(58) Field of Search ..... 427/11, 180, 191, 427/192, 199, 202, 205, 142, 190, 201; 148/537

(56) References Cited

U.S. PATENT DOCUMENTS

| | | | | |
|---|---|---|---|---|
| 3,754,976 | A | * | 8/1973 | Babecki et al. |
| 4,382,811 | A | | 5/1983 | Luscher |
| 4,416,421 | A | | 11/1983 | Browning |
| 4,430,360 | A | | 2/1984 | Bill |
| 4,552,784 | A | | 11/1985 | Chu |
| 4,576,874 | A | | 3/1986 | Spengler |
| 4,610,698 | A | | 9/1986 | Eaton |
| 4,639,399 | A | | 1/1987 | Aprigliano |
| 4,714,622 | A | | 12/1987 | Omori et al. |
| 4,854,196 | A | | 8/1989 | Mehan |
| 4,880,614 | A | | 11/1989 | Strangman |
| 5,024,884 | A | | 6/1991 | Otfinoski |
| 5,059,095 | A | | 10/1991 | Kushner |
| 5,076,897 | A | | 12/1991 | Wride |
| 5,141,769 | A | * | 8/1992 | Platz |
| 5,180,285 | A | | 1/1993 | Lau |
| 5,210,944 | A | | 5/1993 | Monson |
| 5,302,414 | A | | 4/1994 | Alkhimov |
| 5,330,790 | A | * | 7/1994 | Calkins |
| 5,476,363 | A | * | 12/1995 | Freling et al. |
| 5,607,561 | A | | 3/1997 | Gruver |
| 5,660,320 | A | | 8/1997 | Hoffmuller |
| 5,665,217 | A | | 9/1997 | Gruver et al. |
| 5,702,574 | A | | 12/1997 | Foster et al. |
| 5,704,759 | A | | 1/1998 | Draskovich |
| 5,912,087 | A | | 6/1999 | Jackson |
| 5,932,356 | A | | 8/1999 | Sileo et al. |

(List continued on next page.)

FOREIGN PATENT DOCUMENTS

EP 0 718 420 A1 12/1995

OTHER PUBLICATIONS

Smith, M.F., et al. Cold Spray Direct Fabrication—High Rate, Solid State, Material Consolidation. To be published in the Proc. Of the Fall 1998 Meeting of the Materials Research Society, Boston, MA, Nov. 30–Dec. 4, 1998, 12 pages.

(List continued on next page.)

*Primary Examiner*—Fred J. Parker

(57) ABSTRACT

An abrasive coating and a process for forming the abrasive coating by co-depositing hard particles within a matrix material onto a substrate using a cold spray process. The cold sprayed combination of hard particles and matrix material provides a coating that is wear, erosion and oxidation resistant. The abrasive coating may have different compositions across its depth. The hard particles may be deposited at different densities across the thickness of the matrix material. A first layer of the abrasive coating proximate the surface of the substrate may be devoid of hard particles.

10 Claims, 1 Drawing Sheet

U.S. PATENT DOCUMENTS

| | | | |
|---|---|---|---|
| 5,952,110 | A | 9/1999 | Schell |
| 5,997,248 | A | 12/1999 | Ghasripoor |
| 6,015,586 | A | 1/2000 | Omori |
| 6,060,174 | A | 5/2000 | Sabol |
| 6,102,656 | A | 8/2000 | Nissley |
| 6,106,959 | A | 8/2000 | Vance |
| 6,194,086 | B1 | 2/2001 | Nenov |
| 6,251,494 | B1 | 6/2001 | Schreiber |

OTHER PUBLICATIONS

Gilmore,D.L., et al. Particle Velocity and Deposition Efficiency in the Cold Spray Process. Journal of Thermal Spray Technology vol. 8(4) Dec. 1999, pp576–582.

Kreye, H., et al. Cold Spraying—A Study of Process and Coating Characteristics, pp 419–422. No date.

Dykhuizen, R.C., et al. Gas Dynamic Principles of Cold Spray. Journal of Thermal spray Technology vol. 7(2) Jun. 1998, pp 205–212.

Dykhuizen, R.C., et al. Impact of High Velocity Cold Spray Particles. Journal of Thermal Spray Technology vol. 8(4) Dec. 1999, pp 559–564.

Smith, Mark F. Overview of Cold Spray. Sandia National Laboratories, 20 pages. Albequerque, NM, Jul. 14–15, 1999.

Smith, Mark F., et al. Thermal Spray at Sandia. Sandia National Laboratories MFS LMP 80428, 13 pages. No date.

Sandia's Approach to Cold Spray Research. Sandia National Laboratories, 15 pages. No date.

* cited by examiner

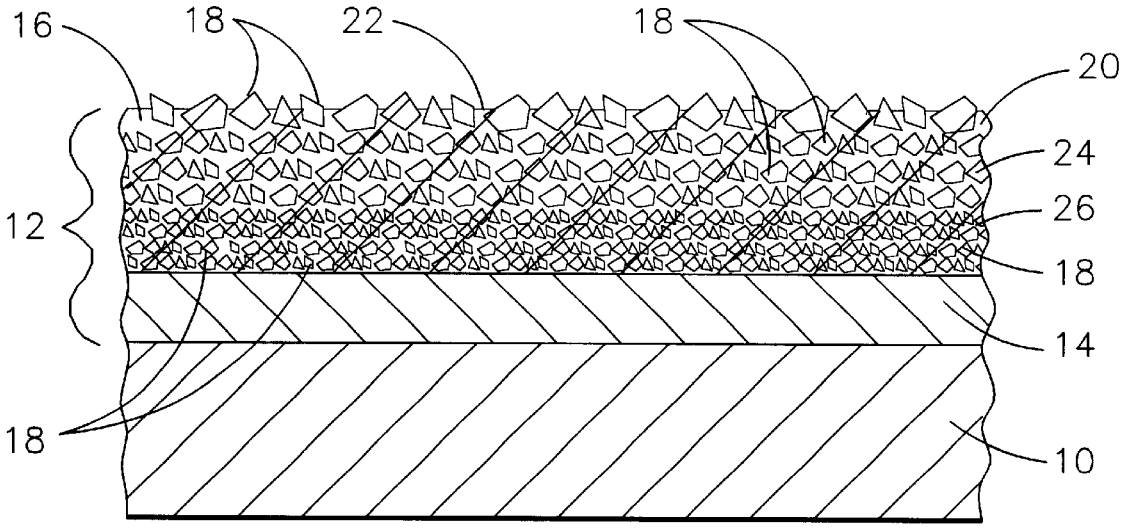
16
18
22
18
20
24
12
26
18
14
18
10

MIXED POWDER DEPOSITION OF COMPONENTS FOR WEAR, EROSION AND ABRASION RESISTANT APPLICATIONS

This application claims benefit of the Dec. 5, 2001, filing date of U.S. provisional patent application No. 60/336,825.

FIELD OF THE INVENTION

This invention relates in general to the field of materials technology and more specifically to the field of abrasive coatings for high temperature applications. In particular, the present invention pertains to an abrasive coating and a process for depositing that coating on component parts of a turbine combustion engine where the hard particles are co-deposited with a matrix material by means of a cold spraying process. Together, the hard particles and matrix material form an abrasive coating that provides a protective layer for the component parts so they are wear, erosion and abrasion resistant when used in high temperature environments such as a gas turbine.

BACKGROUND OF THE INVENTION

It is well known that increasing the firing temperature in the combustion portions of a turbine may increase the power and operational efficiency of a gas turbine engine or a combined cycle power plant incorporating such a gas turbine engine. The demand for improved performance has resulted in advanced turbine designs wherein the peak combustion temperature may reach 1,400 degrees C. or more. Special materials are needed for components exposed to such temperatures. Nickel and cobalt based superalloy materials are now used for components in the hot gas flow path, such as combustor transition pieces and turbine rotating and stationary blades. An example of a commercially available superalloy material is IN738 made by Inco Alloys International, Inc.

A metallic bond coat layer may be initially applied to the surface of a component to provide oxidation resistance and improved adhesion of an overlaying ceramic coating. Common metallic bond coat materials include MCrAlY and MCrAlRe, where M may be nickel, cobalt or iron or a mixture thereof. It is known in the art to apply the metallic bond coat layer by any one of several thermal spray processes, including low-pressure plasma spray (LPPS), air plasma spray (APS) and high velocity oxy-fuel (HVOF). Such processes propel the MCrAlY or MCrAlRe material, or other suitable materials, in a molten plasma state against the surface of the superalloy substrate where it cools and solidifies to form a coating. Such thermal spray processes are known to result in a significant amount of porosity and the formation of oxygen stringers in the metallic bond coat layer due to the inherent nature of a high temperature process. The release of heat from the molten particles of the metallic bonding materials and the transfer of heat from the high temperature gas used in a thermal spray process also result in a significant increase in the surface temperature of the superalloy substrate material during the metallic bond coat application process. Such elevated temperatures result in localized stresses in the superalloy material upon the cooling of the coating layer, which may have an adverse affect on the performance specifications of the superalloy component. Furthermore, a post-deposition diffusion heat treatment is necessary to provide the required metallurgical bond strength, and such treatment may also have adverse affects on the material properties of the underlying substrate.

To optimize the adhesion of the metallic bond coat to the superalloy substrate, it is desired to have a metal-to-metal contact between the layers. Any contamination, oxidation or corrosion existing on the surface of the substrate may adversely impact the adhesion of the coating layer. A separate cleaning step, such as grit blasting with alumina particles, is known in the art and may be used to clean the target surface. However, such process may leave trace amounts of the cleaning material on the surface. After even a short period of exposure to moisture in air, the target surface may begin to oxidize. Handling or storing of the component after the cleaning step may introduce additional contaminants to the previously clean surface. The environment of the prior art thermal spraying processes also contributes to the oxidation of the substrate during the coating process due to the presence of high temperature, oxygen and other chemicals. An improved process in the art is desirable to minimize the risk of oxidation during the application process.

It is also known in the art that the operational specifications of certain components within gas turbine engines require that hard particles abrade the coatings of other surfaces such as a turbine blade tip abrading the interior coating of a ring segment during operation. For example, U.S. Pat. No. 5,702,574 discloses a jig and the process by which the tip portion of a gas turbine blade is provided with hard particles embedded within a matrix material. The tip of the blade is designed to run against the inside surface of a blade encapsulating ring segment during operation of the gas turbine. As little clearance as possible is desired between the blade tips and the inside surface of the ring segment in order to minimize bypass flow of air and other gases past the tips of the blades. The material covering the inside surface of the ring segment is designed to be softer than the material on the blade tips so that as the abrasive material on the blade tips interacts with the interior surface of the ring segment, a very small gap is formed between the blade tips and the ring segment, which minimizes gas losses during operation of the turbine. In accordance with the '574 patent, a plurality of blades may be mounted in a hollow jig having at least one ring of circumferentially disposed apertures through which the tips of the blades are inserted. The tips of the blades are then provided, by electrodeposition, with a coating of hard particles embedded within a matrix.

Electrodeposition is well known in the art and employed in the disclosure of U.S. Pat. No. 5,702,574 first identified above. For instance, the disclosed process includes situating the turbine blade tips within a jig such that they are encountered by a plating solution having hard particles entrained therein. As the particles encounter the tips they tend to settle on the tips where they become embedded in a metal that is being simultaneously plated out. This electrodeposition process, as well as other similar processes employing solutions such as electroplating or electroless plating, does not provide a means for precisely controlling the placement of abrasive particles on the blade tips, if desired.

Additionally, the invention disclosed in U.S. Pat. No. 5,702,574 includes deposition of an infill material by means of vibrating the jig assembly in order to coat regions of the blade tips that might otherwise be depleted of abrasive particles. Also, U.S. Pat. No. 5,076,897 discloses a similar vibration means used to plate infill of MCrAlY around abrasive particles deposited on portions of the blade tips. While electrodeposition and similar processes achieve good bonds they typically take several hours to perform and, in the case of depositing abrasive particles on the tips of turbine blades known in the art, must be performed in conjunction with rather elaborate apparatus that contribute to the cost of manufacture.

The known processes used to deposit abrasive particles within a matrix material on the tips of turbine blades, for example, have limitations such as they expose the underlying substrate to high temperatures, are time consuming, expensive and don't necessarily achieve an optimum deposition of particles. The known apparatuses used in conjunction with these processes may be relatively elaborate and not easily adaptable for field repair, which increases the costs of manufacture or repair. Thus, an improved process is needed for depositing abrasive particles dispersed within a matrix material that will entrap the abrasive particles, sufficiently bond to a substrate, resist oxidation and possess sufficient mechanical properties to maintain its shape on the substrate.

BRIEF SUMMARY OF THE INVENTION

The present invention uses a process, referred to herein as a cold spray process, to deposit hard particles that act as an abrasive onto a substrate to form an abrasive coating that is wear, erosion and abrasion resistant. The cold spray process may be used to co-deposit the hard particles with a matrix material to form a matrix composition on the substrate having the hard particles entrapped therein. The matrix material may be an MCrAlY composition or other suitable compositions provided the matrix material entraps the hard particles, forms a sufficient bond strength with the substrate, is resistant to high temperatures and oxidation, and has sufficient mechanical properties to maintain its shape on the substrate. The hard particles may be cubic boron nitride, diamond or other suitable particles having an appropriate level of hardness. The cold spray process may also be used to embed the hard particles directly into the superalloy substrate without the need for an accompanying matrix material.

One advantage of the present invention over the prior art methods of applying coatings using high temperature processes is that the substrate does not incur any damaging or debilitating effects often associated with high temperature coating applications. The cold spray process of the present invention may co-deposit the hard particles and matrix material in a low temperature environment, which prevents the substrate from suffering the adverse consequences such as altering heat-treated properties. Also, there is no need for a high temperature heat treatment following the deposition of the matrix material. As a result, the initial inter-diffusion zone between the substrate and matrix material is minimized. Further, the application of the matrix material using the cold spray process may be accomplished without masking, thereby eliminating process steps and eliminating the geometric discontinuity normally associated with the edge of a masked area. This feature also provides a cost savings advantage over prior art methods that require masking.

In one aspect of the present invention, the cold spray process allows for the co-deposition of a matrix material and hard particles on a wide range of substrates so that the hard particles are dispersed and entrapped within the matrix material. This process may be used with both new and service-run gas turbine components, for example. The co-deposition of the matrix material and hard particles may be effected by directing relative quantities of their constituent particles toward the substrate surface at a velocity sufficiently high to cause at least some of the matrix material particles to deform and to bond to the substrate surface while entrapping at least a portion of the hard particles within the matrix material to form a matrix composition on the substrate. The matrix composition forms an abrasive coating on the substrate. One advantage of the present invention is that the cold spray process may produce an abrasive coating having essentially no porosity and no oxygen stringers. These properties of the abrasive coating may increase its resistance to oxidation during operation, which is an improvement over known methods for applying coatings at high temperatures.

In one embodiment of the present invention, the depth of the matrix material may be varied along a surface of a substrate, so that a thicker coating is applied in those areas of the substrate exposed to the highest temperatures or those subject to higher incidence of rub encounters during operation, such as the tips of gas turbine blades rub encountering the inner surface of a ring segment during operation. Also, the composition of the matrix material may be varied along a surface of a substrate or across the depth of the matrix material if desired. This may be advantageous in that the consumption of an expensive material may be limited by applying it to only those portions of the substrate where the resulting benefit is necessary. Further, the composition of a first layer of the matrix material may be selected to minimize inter-diffusion with the underlying substrate material, and the composition of a second layer may be selected to optimize resistance to oxidation and corrosion.

Another advantage of the present invention is that the cold spray process permits the co-deposition of the matrix material and hard particles to be precisely controlled so that a layer or layers of hard particles may be dispersed within the matrix material, as the specific application requires. For instance, an exemplary embodiment of the present invention deposits an abrasive coating on the tips of gas turbine blades so that the hard particles are at their highest practical particle density per unit volume of the matrix material at or near the surface of the matrix material. This ensures a sufficient rub encounter with the interior surface of the ring segment during operation of the turbine. A high density of hard particles near the surface of the matrix material is desirable because the hard particles may oxidize over time, which may reduce the effectiveness of the abrasive coating. Varying the hard particle density per unit volume of matrix material across a gradient of layers may also extend the life cycle of the abrasive coating or achieve other performance requirements. Similarly, if desired, the cold spray process may be used with varying sizes of hard particles. Varying the size of the hard particles across the matrix material's depth or along its surface may also prove to be advantageous depending on the specific application.

The cold spray process may also be used to deposit an initial layer of the matrix material on the surface of the substrate devoid or substantially devoid of hard particles then co-depositing the matrix material and hard particles to complete the abrasive coating. The initial layer of matrix material may increase the bond strength of the matrix material to the substrate and enhance oxidation resistance in that area. In one embodiment this initial layer has a depth approximately equal to the average diameter of the hard particles, which minimizes the likelihood that hard particles will inhibit the bond strength or adherence of the matrix material to the substrate. In an alternate embodiment, the initial layer of matrix material may be deposited first with the hard particles being deposited by themselves in a subsequent step. In this manner, the hard particles are directed at the previously deposited matrix material at a sufficient velocity so that they are embedded within the matrix material.

In another aspect of the present invention, the cold spray process may be used to directly deposit the hard particles onto the surface of a substrate without the need for a matrix material provided the composition of the substrate permits the hard particles to be embedded or entrapped therein. For example, a nickel base superalloy substrate, such as a gas turbine blade, may be sufficiently ductile to permit hard particles to be directly embedded into the substrate. If necessary, the substrate may be heated to within a specified temperature range prior to, during or after the deposition of the hard particles to ensure they are embedded and retained within the substrate.

Furthermore, the present invention takes advantage of the cold spray process to uniformly distribute the hard particles in the matrix material, which is desirable to achieve an even and predictable wearing of the abrasive coating. Providing a uniform distribution of particles helps to ensure they are sufficiently entrapped within the matrix material because the matrix material can substantially surround individual particles. It is, however, acceptable for particles to abut one or more other particles in which case the matrix material may surround adjoining particles. With known methods such as electrodeposition and electroplating or other solution bearing methods, for example, obtaining a uniform distribution of particles is difficult due to the inability to precisely control the particles' deposition during the coating process. Uniformly depositing the hard particles within the matrix material on the tips of turbine blades also ensures a uniform and predictable rub encounter with the inner surface of a ring segment to effectuate a seal between the blade tips and the inner surface of a ring segment.

A further advantage of the present invention is that a desired halo effect of matrix material particles may be produced at the fringe of the cold spray area. In this aspect the particle speed of approach to the target surface is insufficient to cause the particles to bond to the surface of the substrate. Instead of bonding, the particles produce a desired grit blast/cleaning effect. This halo effect may be caused by the spread of particles away from a nozzle centerline due to particle interaction or by specific nozzle design. When the nozzle controlling application of the cold spray compound is directed perpendicular to the target surface the halo may be generally circular around a generally circular area being coated. The halo effect and cleaning action may also have an elliptical shape caused by a non-perpendicular angle between the nozzle centerline and the plane of the substrate target surface if so desired. The halo effect provides a cleaning of the target surface coincident to the application of the matrix material, which improves the adhesion of the coating when compared to prior art devices or methods where some impurities or oxidation may exist on the target surface at the time of material deposition.

Further, at least one embodiment of the present invention is sufficiently portable to permit the deposition of abrasive coatings in-situ, such as on the blades of a gas turbine while the blades are in the turbine at a power plant. This feature provides a significant cost savings relative to know methods that apply coatings with equipment fixed in place or that is otherwise too cumbersome or too costly to transport to remote sites. With this type of equipment the substrate to be treated, such as gas turbine blades requiring a replacement or supplemental coating, must be removed from its remote location and transported to the equipment site then back to its operational location and reinstalled.

These embodiments and advantages of the present invention are provided by way of example, not limitation, and are described more fully below.

BRIEF DESCRIPTION OF THE DRAWINGS

The Sole FIGURE illustrates a cross-sectional view of a substrate on which the abrasive coating is applied.

DETAILED DESCRIPTION OF THE INVENTION

U.S. Pat. No. 5,302,414 dated Apr. 12, 1994, and incorporated by reference herein, and re-examination certificate B1 5,302,414 dated Feb. 25, 1997, describe a cold gas-dynamic spraying process for applying a coating, also referred to herein as the cold spray process. That patent describes a process and apparatus for accelerating solid particles having a size from about 1–50 microns to supersonic speeds in the range of 300–1,200 meters per second and directing the particles against a target surface. When the particles strike the target surface, the kinetic energy of the particles is transformed into plastic deformation of the particles, and a bond is formed between the particles and the target surface. This process forms a dense coating with little or no thermal effect on the underlying target surface.

The applicants have found that a cold spray deposited coating oxidizes more slowly at its surface, which is an important advantage when applied to the tips of turbine blades due to their exposure to high temperatures caused in part by heat of friction when rub encountering the inside surface of a ring segment. Testing has demonstrated that the beta-phase depletion of a cold-sprayed layer of matrix material from the MCrAlY family is substantially less than the beta-phase depletion of the same matrix material deposited by low-pressure plasma spraying (LPPS). Testing to date has been conducted on the LPPS deposited layer, the cold spray deposited layer and a cold spray deposited layer subjected to post deposition heat treatment. Testing has been conducted at a constant temperature of 950 degrees Celsius over 5000 hours. Test results indicate that both cold spray deposited layers have experienced substantially less beta-phase depletion relative to the LPPS deposited layer over the 5000 hours of testing. Thus, the cold spray process provides improved oxidation resistant properties relative to known deposition techniques that rely on high temperatures.

The FIGURE illustrates an exemplary embodiment of the present invention where a substrate 10 has a first layer 14 and a second layer 16 deposited thereon. First layer 14 and second layer 16 are formed of a matrix material 17 where second layer 16 has hard particles 18 dispersed therein. First layer 14, second layer 16 and hard particles 18 form a matrix composition that may be cold sprayed on a substrate 10 to form an abrasive coating 12. In one embodiment the substrate 10 represents the tips of turbine blades used in a gas turbine. Substrate 10 may be of any conventional material suitable for high temperature environments and may include wrought, conventionally cast, directionally solidified (DS) and single crystal (SC) materials. The substrate 10 material may be an iron, nickel or cobalt base superalloy. The matrix material 17 used to form the abrasive coating 12 may be an MCrAlY alloy where M is nickel, cobalt or iron or a combination thereof, or other materials as discussed below. The hard particles 18 may be cubic boron nitride, diamonds or other particles having an average nominal particle diameter of between about 0.005 and 0.010 inches. The cubic boron nitride particles have a Knoop hardness of 4,500 to 5,000 and the diamond particles have a Knoop hardness of about 7,000 to 10,000. Hard particles 18 may vary from these ranges of size and hardness in various combinations depending on the specific application.

Other exemplary embodiments of the present invention may use various compositions of matrix materials to form the abrasive coating 12. In addition to being composed of an MCrAlY alloy, the matrix material 17 may be a metal superalloy, such as a nickel base superalloy, or any metal alloy that has sufficient properties to a) form and maintain a sufficient bond strength between the matrix material 17 and the substrate, b) entrap and retain the abrasive particles 18, c) provide oxidation and high temperature resistance and d) possess sufficient mechanical properties to maintain its shape on the surface of the substrate 10 during operation, such as when the tip of a gas turbine blade rub encounters the interior surface of a corresponding ring segment. For example, it is desirable to maintain compatibility of the coefficients of thermal expansion between the matrix material 17 and the substrate so that during operation of a turbine, for example, the bond strength between them is not weakened beyond performance limits and the matrix material 17 retains its shape sufficiently to retain the hard particles 18 to ensure a proper rub encounter with the ring segment.

As illustrated in the FIGURE, the hard particles 18 may be dispersed across the depth of second layer 16 in distinct layers or grades where each grade may have different levels of hard particle 18 density and hard particles 18 of different sizes. The number of such grades, the density of hard particles 18 per unit volume of the matrix material 17 in each grade and the size of hard particles 18 within each grade may vary depending on the specific application.

By way of example, one embodiment of the present invention uses the cold spray process to co-deposit relative quantities of hard particles 18 and the matrix material 17 to form a matrix composition on the substrate 10, which may represent the tip of a gas turbine blade, to form an abrasive coating 12. Portions of the hard particles 18 may extend above the outer surface 22 of the matrix material 17 to abrade the inner surface of a ring segment of a gas turbine. As the blade tips engage the ring segment, the hard particles 18 abrade a coating on the inner surface of the ring segment to form a seal, which helps to minimize the amount of gas bypassing the blade. The hard particles 18 may be uniformly distributed at the highest practical particle density per unit volume of matrix material 17 while ensuring that the hard particles 18 are sufficiently entrapped within second layer 16. After abrading to establish an initial seal between the blade tip and the ring segment, it is desirable to ensure that at least a portion of the hard particles 18 remain entrapped in the second layer 16 so that the seal may be reestablished or maintained over time if necessary. During operation of the turbine, a portion of the hard particles 18 may be needed to abrade the thermal barrier coating of the ring segment as necessary due to the centrifugal force of the turbine blades or outgrowth formed from the thermal barrier coating during operation of the turbine.

As illustrated by way of example in the FIGURE, an exemplary embodiment of the abrasive coating 12 may include second layer 16 comprising three grades of varying hard particle 18 density across the depth of second layer 16. The first grade 20 closest to the outer surface 22 of second layer 16 has hard particles 18 distributed at their highest density with at least a portion of the hard particles 18 extending above the outer surface. Alternatively, hard particles 18 may lie below the outer surface 22 depending on the specific application. A second grade 24 is provided below the outer surface 22 having a density of hard particles 18 that is less than the density of hard particles 18 contained in the first grade 20. Similarly, a third grade 26 is provided between the second grade 24 and first layer 14 that has a density of hard particles 18 that is less than the density of hard particles 18 contained in the second grade 24. The graded levels of density 20, 24 and 26 create a gradient across the depth of second layer 16 that may vary as a function of the specific application. In an alternate embodiment, the density of hard particles 18 per unit volume of the matrix material 17 may be relatively constant across the depth of abrasive coating 12 so that the hard particles 18 are also entrapped within the first layer 14 as well as within second layer 16. In yet another alternate embodiment the second grade 24 and third grade 26 may be devoid or substantially devoid of hard particles 18 with first layer 20 entrapping the hard particles 18 therein so that the hard particles 18 are concentrated at or near the outer surface 22 of the abrasive coating 12. Other alternate embodiments are readily apparent depending on the specific application.

In one embodiment of the method for applying abrasive coating 12 the first layer 14 is applied prior to second layer 16 and may have a depth that is at least equal to or greater than the average diameter of the hard particles 18. The depth of first layer 14 may range from 0 to 40 mils for applying abrasive coating 12 to the tips of turbine blades, or may be of greater depths depending on the application. Applying first layer 14 prior to second layer 16 so that it is devoid of hard particles 18 ensures a strong bond between first layer 14 and substrate 10 and may improve the oxidation resistance of the abrasive coating 12 in this area. Alternatively, other embodiments of the method may disperse hard particles 18 across all or part of the depth of first layer 14 as more fully described below. After the cold spray deposition of first layer 14, relative quantities of the hard particles 18 and the matrix material 17 particles may be cold sprayed over first layer 14 to form the second layer 16 so that second layer 16 contains the desired quantity, density and size of hard particles 18.

In yet another embodiment of the method, the first layer 14 may be comprised solely of matrix material 17 particles that are cold sprayed onto the substrate 10 to a depth that constitutes the depth of the abrasive coating 12. In this embodiment, the matrix material 17 particles are applied to the necessary depth on the substrate 10 in one step with the relative quantity of hard particles 18 applied during this step being zero. In a subsequent step, after the first layer 14 is formed, the hard particles 18 may be cold sprayed onto the first layer 14 so that the hard particles 18 are embedded and/or entrapped within the first layer 14. During this step, the relative quantity of the matrix material 17 particles may be zero or it may be other quantities if necessary to ensure that hard particles 18 are embedded or entrapped within first layer 14.

In another embodiment of the method the hard particles 18 may be directly cold sprayed onto the substrate 10. In this embodiment there is no need to cold spray the matrix material 17 particles onto the substrate 10 prior to cold spraying the hard particles 18 or co-depositing the matrix material 17 particles with the hard particles 18. For example, the substrate 10 may be a sufficiently ductile nickel base superalloy to permit hard particles 18 to be embedded or entrapped therein using the cold spray process. If necessary, the substrate 10 may be heated before, during or after cold spraying the hard particles 18 onto the substrate 10 to ensure they are properly embedded or to achieve proper retention of the hard particles 18 within the substrate 10. Referring to the FIGURE, in this embodiment the hard particles 18 located near the outer surface 22 of the abrasive coating 12 represent such particles embedded directly into a substrate having a surface 22.

Use of the cold spray process for depositing hard particles 18 with a matrix material 17 to form a matrix composition, such as abrasive coating 12, for example, permits deposition in a continuous process where the relative feed rate of hard particles 18 and/or the matrix material 17 particles may be controlled during deposition to achieve a varying hard particle 18 density across the depth of the matrix composition. The size of hard particles 18 may be similarly controlled by the cold spray process as well as the use of different hard particles 18 having varying hardness.

In one embodiment, the MCrAlY and hard particles 18 are applied as finely divided powder particles having a size of from 0.1 to 50 microns and may be accelerated to speeds of from 500–1,200 meters per second. A feed rate of from 0.1 to 2 grams per second may be deposited while traversing across the surface of substrate 10 at an advance rate of between 0.01–0.4 meters per second. The cold spray process allows for the hard particles 18 to be uniformly distributed at the highest practical particle density per unit volume of matrix material 17 particles. Other densities are attainable depending on the specific application. The hard particles 18 may be distributed at a density that is equal to or greater than what is attainable using know deposition techniques. This is accomplished by an appropriate mixing of the hard particles 18 with the MCrAlY powder particles, or other appropriate matrix material 17 particles, as disclosed in U.S. Pat. No. 5,302,414 previously incorporated herein by reference.

After selecting the target substrate 10, the hard particles 18 and matrix material 17 particles are deposited by the cold spray process in relative quantities. If desired, the first layer 14 may be formed without any hard particles 18 by setting the relative quantity of hard particles to 0 and of the matrix material 17 particles to 100%. These relative quantities may be adjusted during the cold spray process to achieve a desired outcome. For example, after a thickness constituting first layer 14 devoid of hard particles 18 is deposited on the substrate 10 the relative quantities of hard particles 18 and matrix material 17 particles may be changed to begin co-depositing hard particles 18 and the matrix material 17 particles on top of first layer 14 to begin forming second layer 16. Continuing to change these relative quantities permits hard particles 18 to be deposited at varying densities across the depth of second layer 16, for example, or they may be deposited at a relative constant density. Continuing in this manner may yield the embodiment of the FIGURE where three grades 20, 24 and 26 are formed having three different hard particle 18 densities across the second layer 16. Other embodiments may vary these relationships as a function of the specific application. The substrate 10 then continues onto any remaining manufacturing or fabrication processes.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A method of applying an abrasive coating to a substrate comprising the steps of:

providing a substrate;

selecting first solid particles of a matrix material;

selecting second solid particles of an abrasive material; and directing relative quantities of the first solid particles and the second solid particles toward a surface of the substrate at a velocity sufficiently high to cause at least a portion of the first solid particles to deform and to adhere to the substrate so that at least a portion of the second solid particles are entrapped within the matrix material to form a matrix composition.

2. The method of claim 1 further comprising controlling the step of directing to form a first layer of the matrix composition proximate a surface of the substrate wherein the relative quantity of the second particles in the first layer is zero.

3. The method of claim 2 further comprising forming the first layer to have a depth equal to or greater than an average diameter of the second particles.

4. The method of claim 1 further comprising the step of:

directing relative quantities of the first solid particles and the second solid particles toward the surface concurrently; and changing the relative quantities of the first solid particles and the second solid particles during the step of directing so that the second solid particles are entrapped within the matrix material at a density per unit volume of the matrix material that varies across a depth of the matrix composition.

5. The method of claim 2 further comprising controlling the step of directing to form a second layer of the matrix composition having an outer surface of the matrix material wherein a portion of the second particles extend above the outer surface.

6. The method of claim 1 wherein the first particles comprise MCrAlY where M is nickel, boron or iron or a combination thereof and the second particles comprise cubic boron nitride.

7. The method of claim 5 wherein the substrate comprises a tip of a gas turbine blade.

8. The method of claim 6 further comprising selecting the second particles to have a Knoop hardness of between about 4,500 to 10,000.

9. The method of claim 1 further comprising the step of:

selecting a first group of second solid particles having a first size and a second group of second solid particles having a second size; and concurrently directing quantities of the first solid particles and second solid particles from the first group toward the surface, then concurrently directing quantities of the first solid particles and second solid particles from the second group toward me surface, so that the second solid particles entrapped within the matrix material have different sizes in two different regions of the matrix composition.

10. A method of applying an abrasive coating to a substrate comprising the steps of:

providing a substrate;

selecting first solid particles of a matrix material;

selecting second solid particles of an abrasive material;

directing the first solid particles toward a surface of the substrate at a velocity sufficiently high to cause at least a portion of the first solid particles to deform and to adhere to the substrate to farm a layer of matrix material; and directing the second solid particles toward a surface of the layer of matrix material at a velocity sufficiently high to cause at least a portion of the second particles to embed within the layer to form a matrix composition.

* * * * *